US012584356B2

(12) United States Patent
Xin et al.

(10) Patent No.: US 12,584,356 B2
(45) Date of Patent: Mar. 24, 2026

(54) POWER HEAD OF DIRECTIONAL DRILL

(71) Applicant: CCTEG ChongQing Research Institute Co., Ltd., ChongQing (CN)

(72) Inventors: Dezhong Xin, ChongQing (CN); Jun Wan, ChongQing (CN); Hang Chen, ChongQing (CN); Xiaohua Liu, ChongQing (CN); Yuqing Xiao, ChongQing (CN); Jian Pu, ChongQing (CN); Shizhai Zhang, ChongQing (CN); Min Tang, ChongQing (CN); Jinjun Lv, ChongQing (CN); Zhengang Ma, ChongQing (CN); Yuan Wan, ChongQing (CN); Xin Dou, ChongQing (CN); Yi Qin, ChongQing (CN); Fujia Zhou, ChongQing (CN); Xing Wang, ChongQing (CN); Shiping Lu, ChongQing (CN); Keyu Chen, ChongQing (CN); Yange Yang, ChongQing (CN); Shitao Zhang, ChongQing (CN)

(73) Assignee: CCTEG Chongqing Research Institute Co., Ltd., Chongqing (CN)

( * ) Notice: Subject to any disclaimer, the term of this patent is extended or adjusted under 35 U.S.C. 154(b) by 0 days.

(21) Appl. No.: 18/875,710

(22) PCT Filed: Mar. 13, 2024

(86) PCT No.: PCT/CN2024/081335

§ 371 (c)(1),
(2) Date: May 12, 2025

(87) PCT Pub. No.: WO2025/044147

PCT Pub. Date: Mar. 6, 2025

(65) Prior Publication Data

US 2026/0055663 A1 Feb. 26, 2026

(30) Foreign Application Priority Data

Aug. 28, 2023 (CN) ..... 202311092915.5

(51) Int. Cl.
*E21B 7/04* (2006.01)

(52) U.S. Cl.
CPC ..... *E21B 7/04* (2013.01)

(58) Field of Classification Search
CPC ..... E21B 7/04
See application file for complete search history.

(56) References Cited

U.S. PATENT DOCUMENTS

2013/0068490 A1* 3/2013 Van Zee ..... E21B 17/18 173/40
2014/0102799 A1* 4/2014 Stringer ..... E21B 3/02 175/73
2014/0284111 A1* 9/2014 Van Zee ..... E21B 17/18 175/122

FOREIGN PATENT DOCUMENTS

BE 780614 A 7/1972
CN 101158270 A 4/2008
(Continued)

OTHER PUBLICATIONS

Notice of Grant of Patent Right of corresponding CN application 202311092915.5, published on Jul. 1, 2024.
The grant claims of corresponding CN application 202311092915.5.

*Primary Examiner* — Nathaniel C Chukwurah
(74) *Attorney, Agent, or Firm* — Wang Law Firm, Inc.

(57) ABSTRACT

A power head of a directional drill includes a main motor, gearbox, main shaft, active drill pipe, and water swivel. The gearbox has a driving shaft connected to the main motor and engaged with the main shaft via a gear. One end of the main shaft is fixedly connected to the active drill pipe, while the other end of the driving shaft links to an angle adjuster
(Continued)

through the gearbox, enabling efficient toolface adjustment and braking of the main motor. The water swivel mandrel connects to the active drill pipe via a connecting shaft with an axial floating structure. A connecting sleeve near the water swivel forms a hexagonal sleeve sliding pair with the connecting shaft, preventing axial impacts on mandrel support bearings during drilling. This design enhances the service life of the bearings and reduces equipment repairs, improving the reliability and efficiency of the drilling process.

17 Claims, 5 Drawing Sheets

(56) References Cited

FOREIGN PATENT DOCUMENTS

| | | | |
|---|---|---|---|
| CN | 108661578 | A | 10/2018 |
| CN | 208252019 | U | 12/2018 |
| CN | 220469778 | U | 2/2024 |

* cited by examiner

POWER HEAD OF DIRECTIONAL DRILL

FIELD OF INVENTION

The present invention belongs to the technical field of coal mine drills, and relates to a power head of a directional drill.

BACKGROUND ART OF THE INVENTION

During directional drilling by a directional drill, it is usually necessary to adjust a toolface azimuth to change a drilling track direction. Power heads of existing directional drills are basically the same as those of traditional drills, and no device capable of accurately controlling a rotation angle is provided. Toolface azimuth adjustment is driven by a drilling rotary motor with a high rotation speed; in addition, a power head transmission system has a large inertia, which results in a poor control accuracy and a low adjustment efficiency. An existing directional drill usually has only one (or one set of) motor(s), i.e., a main motor which drives a main shaft to rotate, so that the main motor is also used to drive the main shaft to rotate during toolface azimuth adjustment. In a drilling process, a number of drill pipes are certainly in thread connection in a hole, so that only the main motor can be used to drive a main shaft and the drill pipes to rotate forward during toolface azimuth adjustment, and reverse rotation is likely to loosen the thread connection of the drill pipes in the hole, resulting in a bit drop accident. According to a requirement of coal mine drilling speed, the drill pipes are driven by the main motor to rotate at a high speed, and even at a low speed of as high as about 50 r/min (300°/s), so the adjustment accuracy of the system is very low. In addition, the power head transmission system (a main shaft, a gear, etc.) has a large mass and a large inertia, and usually cannot be accurately stopped when toolface azimuth adjustment is completed. Once a preset azimuth is missed, about one circle of forward rotation must be conducted for readjustment, and the process is repeated, resulting in that the adjustment efficiency is very low and not accurate enough.

What's more, during directional drilling, a water swivel is one of the necessary accessories for construction with a directional drill, and is used as a joint of the drill and an external pressure medium to deliver a pressure fluid required for drilling and slag discharge to the drill pipes and a drill bit. A water swivel of an existing drill is generally separated from other components and installed in isolation at a tail end of the main shaft of the power head or a tail end of the last drill pipe; the water swivel usually comprises a mandrel, a water inlet assembly sheathed on the mandrel, a bearing seat sheathed on the mandrel, an end cover detachably connected with the bearing seat, and a back cover detachably connected with the end cover; and a bearing is arranged between the bearing seat and the mandrel, and then the water swivel is directly installed in isolation at a tail end of the main shaft of the power head or a tail end of the last drill pipe through the mandrel. As the water swivel of the existing drill is generally separated from other components and installed in isolation at a tail end of the main shaft of the power head or a tail end of the last drill pipe, an axial hydraulic force in the water swivel of the existing drill is uneven; in addition, no other force conductive structure is provided; therefore, due to an axial hydraulic impact and a drilling vibration impact during drilling, mandrel support bearings of the mandrel are easy to damage and require frequent maintenance, which seriously affects construction efficiency.

A Chinese patent with the publication number of CN103061669B is a typical representative of the prior art, which discloses a large through hole power head of a coal mine directional drill with a braking function. The key is that the large through hole power head comprises a motor, a gearbox, a main shaft, a shaft I and a chuck, wherein the motor is connected with the main shaft through the gearbox, the shaft I is engaged with the main shaft through a gear in the gearbox, the chuck is arranged at a front end of the main shaft, a support ring is installed on a rear end of the main shaft, an oil distribution sleeve is sheathed on the main shaft, the shaft I is connected with a brake through the gearbox, and the brake adopts a wet friction disk structure; a dial of the brake is connected with the shaft I of the power head through a spline, active friction plates are connected with a fork claw of the dial, passive friction plates are connected with an end cover shaft fixed on a brake end cover through the spline, the brake is provided with a piston rod, 6 piston rod springs which are distributed circumferentially and uniformly are sheathed on the piston rod, a front end of the piston rod is provided with a pressure disk, a front end of the pressure disk is provided with 6 active friction plates and 5 passive friction plates layered on top of each other, a tail end of the piston rod is pressed against a front end of the end cover shaft, a pressure cap is arranged in a slot hole in the front end of the end cover shaft, and a shaft end spring is arranged at a bottom of the pressure cap; the front end of the end cover shaft is provided with a locking nut; and a drainage port of the motor is connected with a lower oil port of a shell of the brake, oil flows back to an oil tank through an upper oil port of the shell of the brake, and the piston rod springs are closely matched with the piston rod. Thus, the large through hole power head of a coal mine directional drill has a main shaft braking function, and can simultaneously satisfy two technological processes, i.e., rotary drilling and directional drilling with a downhole motor. However, the large through hole power head of a coal mine directional drill is not provided a device which can accurately control a rotation angle of a toolface azimuth, and a spindle motor is still needed to adjust the rotation angle of the toolface azimuth, so that the toolface azimuth cannot be adjusted accurately; in addition, a brake device thereof has a single function, does not have an angle adjustment function, and adopts a mode of a traditional friction plate, which comprises numerous internal vulnerable parts and requires to replace the parts frequently for maintenance, resulting in relatively difficult maintenance in later operation.

DISCLOSURE OF THE INVENTION

In view of this, the purpose of the present invention is to provide a power head of a directional drill to solve the problem that a toolface azimuth cannot be adjusted accurately during existing directional drilling and the problem that mandrel support bearings in a water swivel are easy to damage due to an axial hydraulic impact and a drilling vibration impact during drilling.

To achieve the above purpose, the present invention provides the following technical solution:

A power head of a directional drill, comprising a main motor, a gearbox and a main shaft, wherein the gearbox is provided with a driving shaft, one end of the driving shaft is connected with the main motor, and the driving shaft is engaged with the main shaft through a gear in the gearbox; the key is that: the other end of the driving shaft is connected with an angle adjuster through the gearbox;

The angle adjuster comprises a transmission shaft, a fixed toothed disk, a moving toothed disk, a rotary seat and a rotary speed reducer with a self-locking function, one end of the transmission shaft is circumferentially and fixedly connected with the driving shaft, the fixed toothed disk and the moving toothed disk are sheathed on the transmission shaft, the fixed toothed disk is engaged with the moving toothed disk through skewed teeth, the fixed toothed disk is circumferentially and fixedly connected with the transmission shaft, the moving toothed disk is rotationally connected with the transmission shaft, and the moving toothed disk can slide along an axial direction of the transmission shaft;

The rotary seat is sheathed on and circumferentially and fixedly connected with the moving toothed disk, and an output disk of the rotary speed reducer is coaxially and fixedly connected with the rotary seat to transfer rotation of the output disk of the rotary speed reducer to the moving toothed disk.

Further, the adjuster also comprises a driving piston and a connecting seat, the driving piston is sheathed on the driving shaft and is located on one side of the fixed toothed disk away from the moving toothed disk, and one end of the driving piston away from the driving shaft is connected with the moving toothed disk;

The connecting seat is sheathed on the driving piston, an outer circle of the connecting seat is divided by three diameters, a middle section has a largest diameter, both end surfaces of the middle section are connected with the gearbox and the rotary speed reducer, respectively, to realize relative axial positioning among the gearbox, the connecting seat and the rotary speed reducer, and an inner diameter of the connecting seat is divided by three apertures, wherein the apertures of two sections away from the gearbox are matched with an outer diameter of the driving piston, and the two sections are sheathed on the driving piston;

The driving piston is a two-stage stepped shaft, a sealing groove is formed in an outer circle of a small-diameter end of the driving piston, a sealing ring is installed in the sealing groove and is matched with a corresponding position of the connecting seat sheathed on the driving piston to form a first seal, an outer circle of a large-diameter end is matched with a sealing ring installed at a corresponding position of the connecting seat to form a second seal, a sealing cavity located between the driving piston and the connecting seat is formed between the first seal and the second seal, an oil inlet communicated with the sealing cavity is arranged on the connecting seat, and the moving toothed disk is pushed by the driving piston to move in a direction away from the fixed toothed disk under the action of hydraulic oil entering the sealing cavity through the oil inlet to enable the moving toothed disk to slide along the axial direction of the transmission shaft.

Further, the angle adjuster also comprises an angle adjuster end cover, the other end of the transmission shaft is rotationally connected in the angle adjuster end cover, the moving toothed disk is a disk-like part with a central through hole, the central through hole is a stepped through hole, one side of the stepped through hole facing the angle adjuster end cover is a large-diameter through hole, the moving toothed disk is sheathed on and slidably connected with the angle adjuster end cover through the large-diameter through hole, one end surface of the moving toothed disk facing the driving piston is provided with first skewed teeth distributed circumferentially, the fixed toothed disk is provided with second skewed teeth engaged with the first skewed teeth, and springs are arranged between an inner end surface of the large-diameter through hole and one end surface of the angle adjuster end cover opposite to the inner end surface to make the first skewed teeth and the second skewed teeth engaged under a thrust force of the springs;

An outer circular surface of the moving toothed disk is provided with lug bosses distributed uniformly, the rotary seat is sheathed on the moving toothed disk and has grooves matched with the lug bosses to be circumferentially and fixedly connected with the moving toothed disk, and one end of the rotary seat is provided with a rotary speed reducer connecting disk which is fixedly connected with the output disk of the rotary speed reducer to transfer the rotation of the output disk of the rotary speed reducer to the moving toothed disk.

Further, a transmission piston is also arranged between the driving piston and the moving toothed disk, the transmission piston is sheathed on and slidably connected with the transmission shaft, one end of the transmission piston is connected with the driving piston, and the other end is connected with the moving toothed disk to transmit a thrust force of the driving piston.

Further, the rotary seat is cylindrical, and one end of the rotary seat away from the rotary speed reducer connecting disk is provided with an end cover connecting disk which is fixedly connected with the angle adjuster end cover.

Further, the fixed toothed disk is provided with a toothed disk and a fixed shaft located in a center of the toothed disk, the second skewed teeth are arranged on the toothed disk, the fixed shaft is inserted into the central through hole of the moving toothed disk, and a keyway is provided in the fixed shaft to enable the fixed toothed disk to be circumferentially and fixedly connected with the transmission shaft through key connection.

Further, the angle adjuster end cover has a three-stage stepped hollow disk-like structure, which is sheathed on the transmission shaft through a bearing, a maximum outer diameter section of the angle adjuster end cover is provided with a flange which is connected with the rotary seat, the maximum outer diameter section is located on one end away from the driving shaft, an intermediate diameter section is used for carrying the rotary seat and limiting an axial movement distance of the moving toothed disk, a minimum diameter section is axially and slidably connected with the large-diameter through hole of the moving toothed disk, and one end surface of the minimum diameter section is provided with a plurality of spring mounting holes which are used for mounting the springs and distributed circumferentially and uniformly.

Further, the driving shaft is arranged in the gearbox, one end surface of the middle section of the connecting seat is connected with the gearbox, one section of the connecting seat close to the gearbox is inserted into the gearbox and is used as an axial stop of the bearing sheathed on the driving shaft, and one section of the connecting seat close to the rotary speed reducer is extended towards an inner part of the rotary speed reducer to be used for installation and guidance of the rotary speed reducer.

A power head of a directional drill, comprising a main motor, a gearbox, a main shaft, an active drill pipe and a water swivel, wherein the main motor is connected with the main shaft through the gearbox, and one end of the main shaft is circumferentially and fixedly connected with the active drill pipe; the key is that: the power head also comprises a connecting shaft and a connecting sleeve, the water swivel comprises a mandrel, a water inlet assembly, a bearing seat, a sealing shaft and mandrel support bearings, the water inlet assembly is sheathed on and rotationally connected with the mandrel, and the bearing seat is sheathed on and rotationally connected with the mandrel through the mandrel support bearings which are arranged in both ends of the bearing seat;

The mandrel is a hollow shaft, a left end of the mandrel is fixedly connected with the connecting shaft, an inner side of a right end of the mandrel is connected with the sealing shaft to seal the right end of the mandrel, the mandrel has a water inlet hole, the water inlet hole is communicated with the water inlet assembly, the water inlet assembly comprises a water inlet and a shell communicated with the water inlet, an inner cavity of the shell has a symmetrical structure with a plane of symmetry perpendicular to an axis of the mandrel so as to make the shell uniformly stressed in an axial direction, the water inlet assembly is sheathed on the mandrel through the shell, and the inner cavity of the shell is communicated with the water inlet hole of the mandrel;

The connecting shaft is a hollow shaft and is arranged in the main shaft, both ends of the connecting shaft are connected with the mandrel and the active drill pipe having an axial floating structure, respectively, a hexagonal head is arranged on one end of the connecting shaft close to the mandrel, the connecting sleeve is fixedly connected with one end of the main shaft close to the water swivel and is sheathed on the connecting shaft, and a hexagonal hole matched with the hexagonal head is formed in the connecting sleeve to form a sliding connection between the connecting shaft and the connecting sleeve to limit rotation, thus to enable the connecting shaft and the mandrel to float axially.

Further, the power head of a directional drill also comprises a chuck, the chuck is connected with one end of the main shaft away from the water swivel and rotates with the main shaft, the axial floating structure of the active drill pipe comprises springs and a drill pipe end cover, the active drill pipe is in key connection with the chuck to make the main shaft circumferentially and fixedly connected with the active drill pipe, the springs are arranged on one end surface of the active drill pipe close to the chuck to enable the active drill pipe to float axially, and the drill pipe end cover is sheathed on the active drill pipe and is fixedly connected with the chuck to limit an axial floating distance of the active drill pipe.

Further, assuming that a maximum distance between the end surface of the active drill pipe close to the chuck and an end surface of the chuck corresponding to the active drill pipe is a, and a pitch of threads of the active drill pipe and a drill pipe joint connected with the active drill pipe is p, then $a \leq p$.

Further, a uniformly distributed multi-section axial stop end surface is formed by the hexagonal head of the connecting shaft and an intermediate cylindrical section, and the stop end surface is matched with one end surface of the connecting sleeve close to the connecting shaft; assuming that when the active drill pipe floats axially to a leftmost end, a distance between the stop end surface and the end surface of the connecting sleeve close to the connecting shaft is b, then $b>a$.

Further, the mandrel is fixedly connected with the connecting shaft by threads, threads of the mandrel are external threads, and threads of the connecting shaft are internal threads.

Further, the right end of the mandrel is fixedly connected with a cover plate to fix the sealing shaft axially.

A power head of a directional drill, comprising a main motor, a gearbox, a main shaft, an active drill pipe and a water swivel, wherein the gearbox is provided with a driving shaft, one end of the driving shaft is connected with the main motor, the driving shaft is engaged with the main shaft through a gear in the gearbox, and one end of the main shaft is circumferentially and fixedly connected with the active drill pipe; the key is that: the other end of the driving shaft is connected with an angle adjuster through the gearbox;

The angle adjuster comprises a transmission shaft, a fixed toothed disk, a moving toothed disk, a rotary seat and a rotary speed reducer with a self-locking function, one end of the transmission shaft is circumferentially and fixedly connected with the driving shaft, the fixed toothed disk and the moving toothed disk are sheathed on the transmission shaft, the fixed toothed disk is engaged with the moving toothed disk through skewed teeth, the fixed toothed disk is circumferentially and fixedly connected with the transmission shaft, the moving toothed disk is rotationally connected with the transmission shaft, and the moving toothed disk can slide along an axial direction of the transmission shaft;

The rotary seat is sheathed on and circumferentially and fixedly connected with the moving toothed disk, and an output disk of the rotary speed reducer is coaxially and fixedly connected with the rotary seat to transfer rotation of the output disk of the rotary speed reducer to the moving toothed disk;

The power head of a directional drill also comprises a connecting shaft and a connecting sleeve, the water swivel comprises a mandrel, a water inlet assembly, a bearing seat, a sealing shaft and mandrel support bearings, the water inlet assembly is sheathed on and rotationally connected with the mandrel, and the bearing seat is sheathed on and rotationally connected with the mandrel through the mandrel support bearings which are arranged in both ends of the bearing seat;

The mandrel is a hollow shaft, a left end of the mandrel is fixedly connected with the connecting shaft, an inner side of a right end of the mandrel is connected with the sealing shaft to seal the right end of the mandrel, the mandrel has a water inlet hole, the water inlet hole is communicated with the water inlet assembly, the water inlet assembly comprises a water inlet and a shell communicated with the water inlet, an inner cavity of the shell has a symmetrical structure with a plane of symmetry perpendicular to an axis of the mandrel so as to make the shell uniformly stressed in an axial direction, the water inlet assembly is sheathed on the mandrel through the shell, and the inner cavity of the shell is communicated with the water inlet hole of the mandrel;

The connecting shaft is a hollow shaft and is arranged in the main shaft, both ends of the connecting shaft are connected with the mandrel and the active drill pipe having an axial floating structure, respectively, a hexagonal head is arranged on one end of the connecting shaft close to the mandrel, the connecting sleeve is fixedly connected with one end of the main shaft close to the water swivel and is sheathed on the connecting shaft, and a hexagonal hole matched with the hexagonal head is formed in the connecting sleeve to form a sliding connection between the connecting shaft and the connecting sleeve to limit rotation, thus to enable the connecting shaft and the mandrel to float axially.

Further, the adjuster also comprises a driving piston and a connecting seat, the driving piston is sheathed on the driving shaft and is located on one side of the fixed toothed disk away from the moving toothed disk, and one end of the driving piston away from the driving shaft is connected with the moving toothed disk;

The connecting seat is sheathed on the driving piston, an outer circle of the connecting seat is divided by three diameters, a middle section has a largest diameter, both end surfaces of the middle section are connected with the gearbox and the rotary speed reducer, respectively, to realize relative axial positioning among the gearbox, the connecting seat and the rotary speed reducer, and an inner diameter of the connecting seat is divided by three apertures, wherein the apertures of two sections away from the gearbox are matched with an outer diameter of the driving piston, and the two sections are sheathed on the driving piston;

The driving piston is a two-stage stepped shaft, a sealing groove is formed in an outer circle of a small-diameter end of the driving piston, a sealing ring is installed in the sealing groove and is matched with a corresponding position of the connecting seat sheathed on the driving piston to form a first seal, an outer circle of a large-diameter end is matched with a sealing ring installed at a corresponding position of the connecting seat to form a second seal, a sealing cavity located between the driving piston and the connecting seat is formed between the first seal and the second seal, an oil inlet communicated with the sealing cavity is arranged on the connecting seat, and the moving toothed disk is pushed by the driving piston to move in a direction away from the fixed toothed disk under the action of hydraulic oil entering the sealing cavity through the oil inlet to enable the moving toothed disk to slide along the axial direction of the transmission shaft.

Further, the angle adjuster also comprises an angle adjuster end cover, the other end of the transmission shaft is rotationally connected in the angle adjuster end cover, the moving toothed disk is a disk-like part with a central through hole, the central through hole is a stepped through hole, one side of the stepped through hole facing the angle adjuster end cover is a large-diameter through hole, the moving toothed disk is sheathed on and slidably connected with the angle adjuster end cover through the large-diameter through hole, one end surface of the moving toothed disk facing the driving piston is provided with first skewed teeth distributed circumferentially, the fixed toothed disk is provided with second skewed teeth engaged with the first skewed teeth, and springs are arranged between an inner end surface of the large-diameter through hole and one end surface of the angle adjuster end cover opposite to the inner end surface to make the first skewed teeth and the second skewed teeth engaged under a thrust force of the springs;

An outer circular surface of the moving toothed disk is provided with lug bosses distributed uniformly, the rotary seat is sheathed on the moving toothed disk and has grooves matched with the lug bosses to be circumferentially and fixedly connected with the moving toothed disk, and one end of the rotary seat is provided with a rotary speed reducer connecting disk which is fixedly connected with the output disk of the rotary speed reducer to transfer the rotation of the output disk of the rotary speed reducer to the moving toothed disk.

The present invention has the following beneficial effects:

1. In the power head of a directional drill provided by the present invention, a mechanism of the power head is improved, the angle adjuster is arranged on one side of the gearbox away from the main motor, and the transmission shaft in the angle adjuster is circumferentially and fixedly connected with the driving shaft, so as to realize accurate and efficient adjustment of the toolface azimuth and prevent rebounding and rotation of the main shaft of the power head caused by elastic deformation of the drill pipe by the angle adjuster with functions of accurate angle adjustment, locking and anti-rotation, which solves the problems of lack of a special toolface azimuth adjustment device, low precision and low efficiency of track adjustment, and being difficult to realize automatic directional drilling in the prior art;

At the same time, a driving force required for toolface azimuth adjustment is greatly reduced, a good energy saving effect is achieved, the structure of a rotary brake device of the main motor is simplified, and the functions of a large number of internal parts are transferred to an external rotary speed reducer, which greatly reduces difficulty of maintenance, and reduces consumption of wearing parts.

2. In the present invention, the water swivel is integrally connected with the active drill pipe through the connecting shaft, so manual installation and removal of the water swivel during drilling is avoided, which is more suitable for an intelligent drill; the water inlet assembly in the water swivel is connected with the mandrel by the shell which is symmetrical about a median surface to make the water inlet assembly uniformly stressed in an axial direction of the mandrel, so as to avoid stress imbalance of the mandrel support bearings caused when a drilling driving medium enters the mandrel; the mandrel is connected with the active drill pipe having an axial floating structure by the connecting shaft, which effectively prevents the water swivel from withstanding an axial impact from the drill pipe during drilling; the axial impact is transferred to the main shaft and the chuck through the active drill pipe and cushioned by the springs, which further prevents the mandrel support bearings from the axial impact, thereby increasing a service life thereof and reducing the number of equipment repairs.
3. The present invention adopts a combined drill pipe connecting device for the active drill pipe and the chuck, which can realize rapid switching between working conditions of drilling and fishing drill pipes by disassembling a few parts.

Other advantages, objectives and features of the present invention will be illustrated in the following description to some extent, and will be apparent to those skilled in the art based on the following investigation and research to some extent, or can be taught from the practice of the present invention. The objectives and other advantages of the present invention can be realized and obtained through the following description.

DESCRIPTION OF THE DRAWINGS

To enable the purpose, the technical solution and the advantages of the present invention to be more clear, the present invention will be preferably described in detail below in combination with the drawings, wherein.

Figure 1:
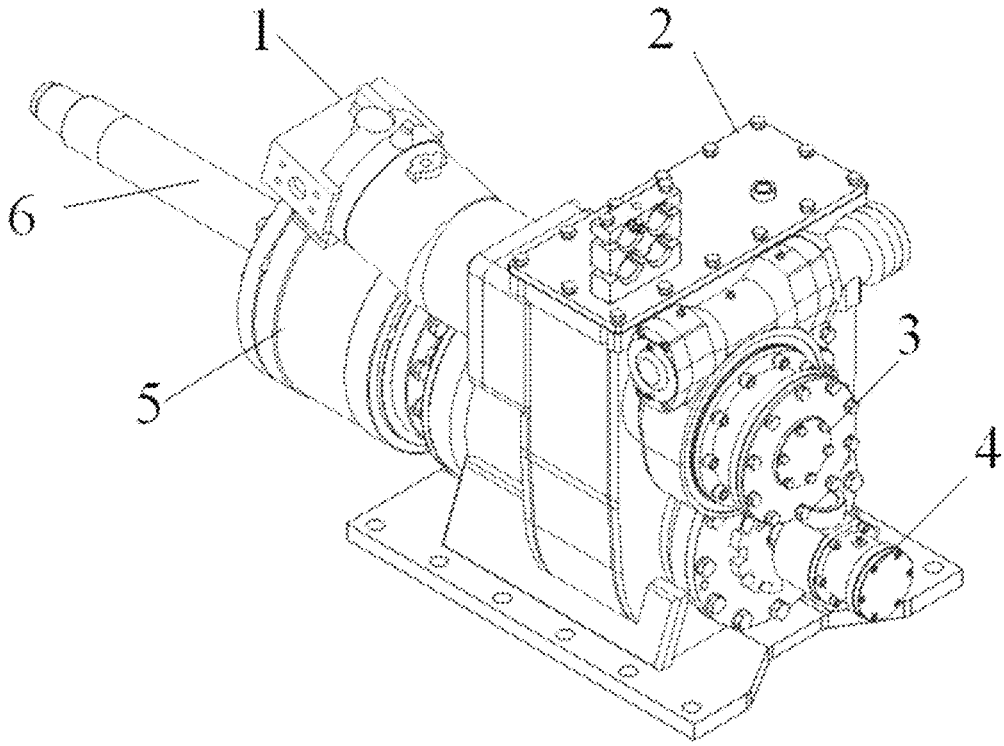
FIG. 1 is a structural schematic diagram of a power head of a directional drill in the present invention.

Reference signs: 1—main motor, 2—gearbox, 201—driving shaft, 3—angle adjuster, 301—transmission shaft, 302—driving piston, 302*a*—sealing groove, 302*b*—outer circle of large-diameter end, 303—rotary speed reducer, 304—transmission piston, 305—fixed toothed disk, 305*a*—toothed disk, 305*b*—fixed shaft, 306—moving toothed disk, 306*a*—lug boss, 306*b*—first skewed tooth, 307—angle adjuster end cover, 307*a*—maximum outer diameter section, 307*b*—intermediate diameter section, 307*c*—minimum outer diameter section, 307*d*—spring mounting hole, 308—bearing gland, 309—spring, 310—rotary seat, 310*a*—rotary speed reducer connecting disk, 310*b*—end cover connecting disk, 310*c*—groove, 311—flat key, 4—water swivel, 401—mandrel support bearing, 402—mandrel, 403—water inlet assembly, 404—bearing seat, 405—grease nipple, 406—distance sleeve, 407—water swivel end cover, 408—cover plate, 409—sealing shaft, 5—chuck, 6—active drill pipe, 7—connecting shaft, 701—external thread, 702—hexagonal head, 703—internal thread, 8—connecting sleeve, 9—connecting seat, 10—main shaft, Y—sealing cavity.

DETAILED DESCRIPTION OF THE INVENTION

Embodiments of the present invention are described below through specific embodiments. Those skilled in the art can understand other advantages and effects of the present invention easily through the disclosure of the description. The present invention can also be implemented or applied through additional different specific embodiments. All details in the description can be modified or changed based on different perspectives and applications without departing from the spirit of the present invention. It should be noted that the figures provided in the following embodiments only exemplarily explain the basic conception of the present invention, and if there is no conflict, the following embodiments and the features in the embodiments can be mutually combined.

Wherein the drawings are only used for exemplary description, are only schematic diagrams rather than physical diagrams, and shall not be understood as a limitation to the present invention. In order to better illustrate the embodiments of the present invention, some components in the drawings may be omitted, scaled up or scaled down, and do not reflect actual product sizes. It should be understandable for those skilled in the art that some well-known structures and description thereof in the drawings may be omitted.

Same or similar reference numerals in the drawings of the embodiments of the present invention refer to same or similar components. It should be understood in the description of the present invention that terms such as "upper", "lower", "left", "right", "front" and "back" indicate direction or position relationships shown based on the drawings, and are only intended to facilitate the description of the present invention and the simplification of the description rather than to indicate or imply that the indicated device or element must have a specific direction or constructed and operated in a specific direction, and therefore, the terms describing position relationships in the drawings are only used for exemplary description and shall not be understood as a limitation to the present invention; for those ordinary skilled in the art, the meanings of the above terms may be understood according to specific conditions.

Figure 2:
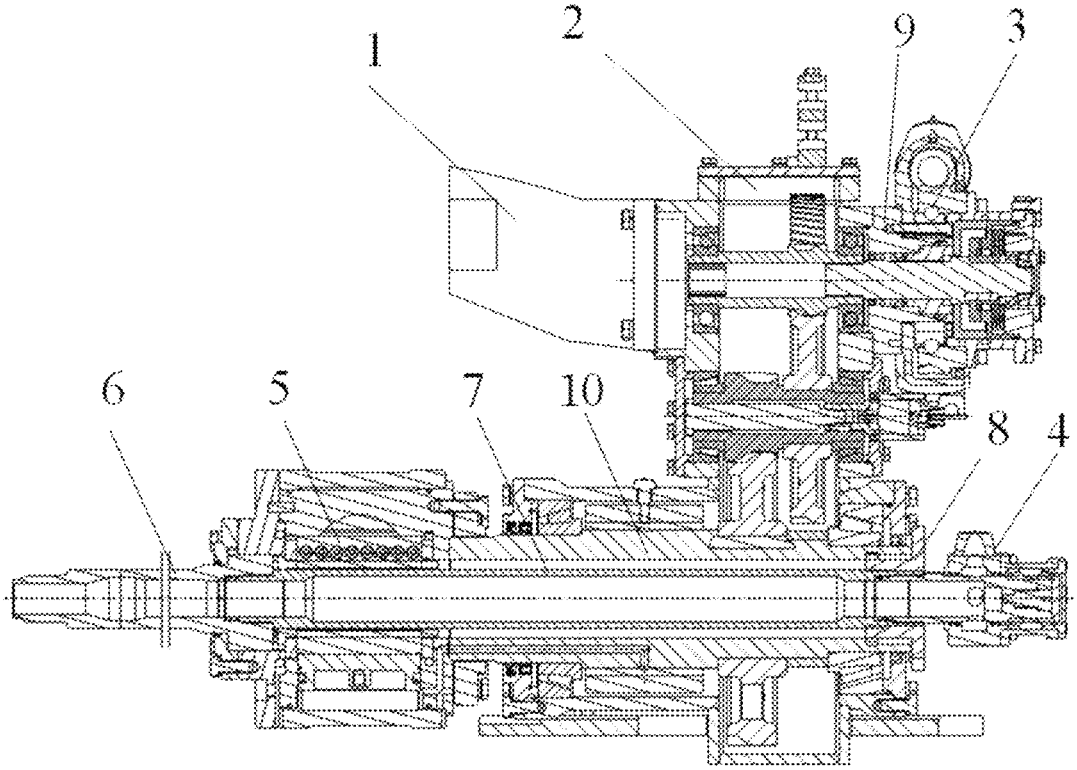
FIG. 2 is a sectional structural schematic diagram of a power head of a directional drill in the present invention.
Figure 3:
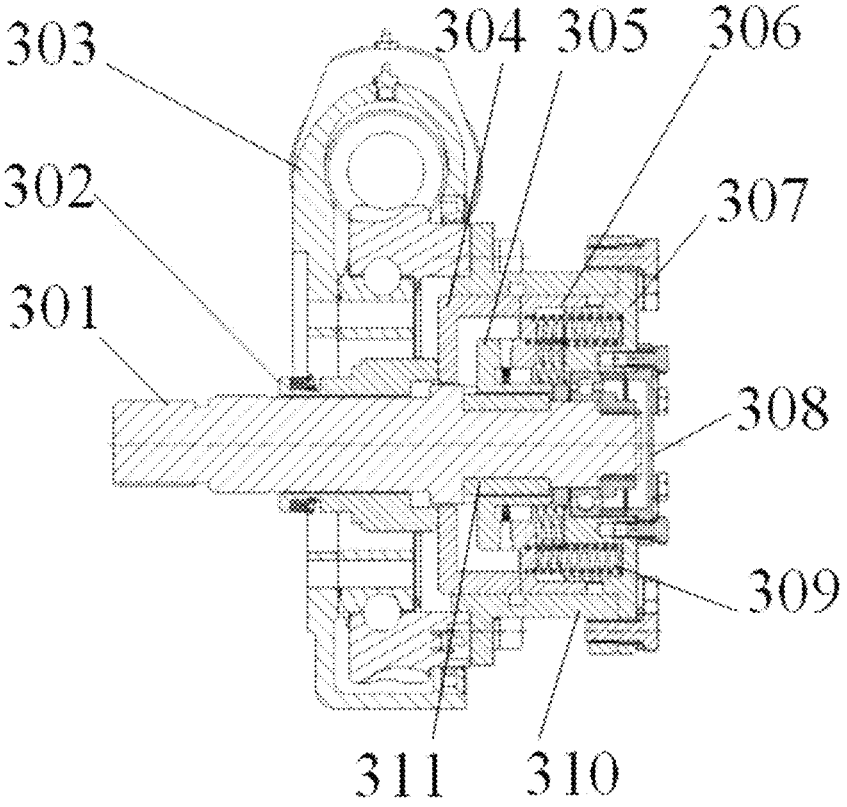
FIG. 3 is a structural schematic diagram of an angle adjuster in the present invention.
Figure 4:
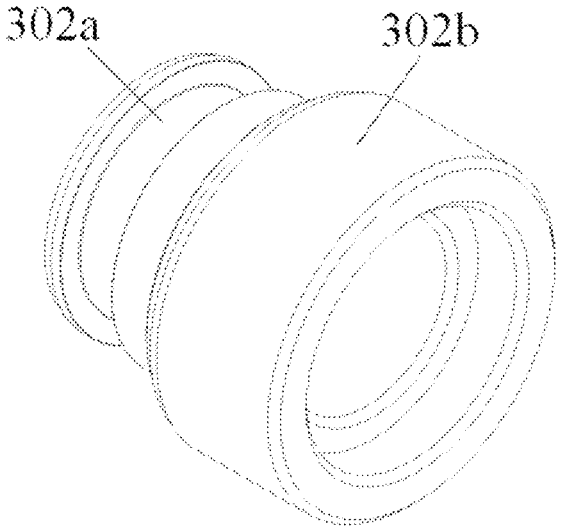
FIG. 4 is a structural schematic diagram of a driving piston of an angle adjuster in the present invention.
Figure 5:
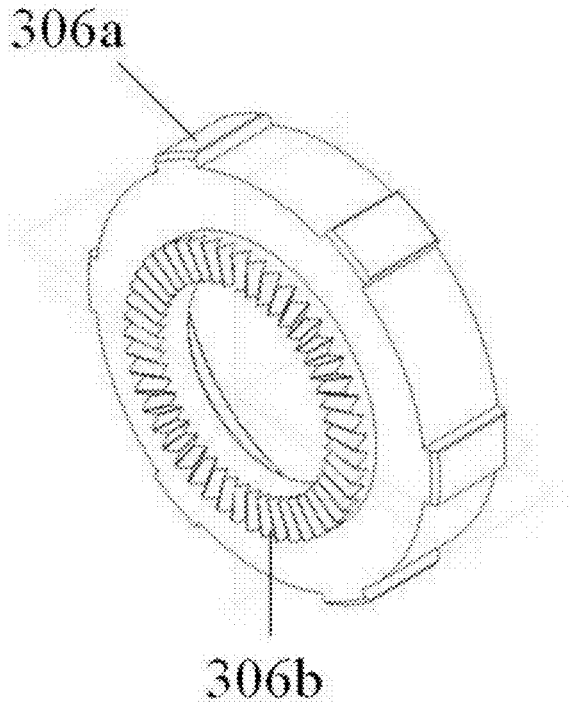
FIG. 5 is a structural schematic diagram of a moving toothed disk of an angle adjuster in the present invention.
Figure 6:
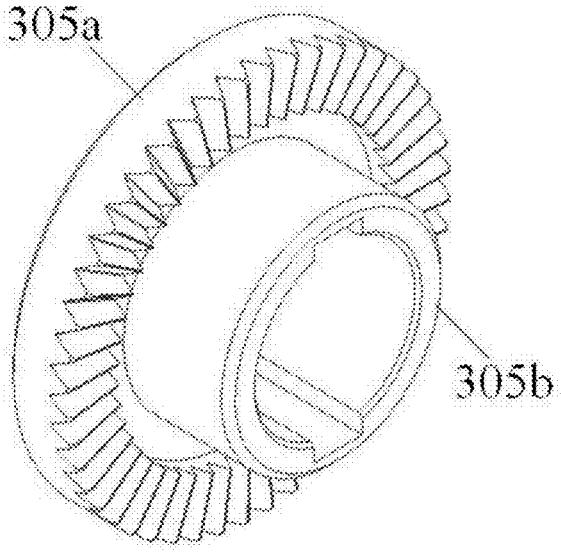
FIG. 6 is a structural schematic diagram of a fixed toothed disk of an angle adjuster in the present invention.
Figure 7:
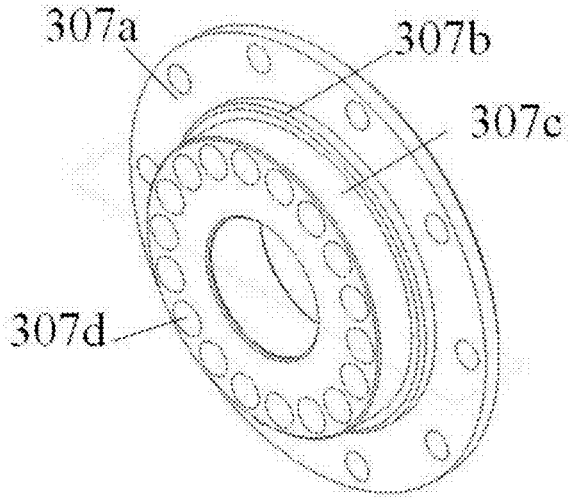
FIG. 7 is a structural schematic diagram of an end cover of an angle adjuster in the present invention.
Figure 8:
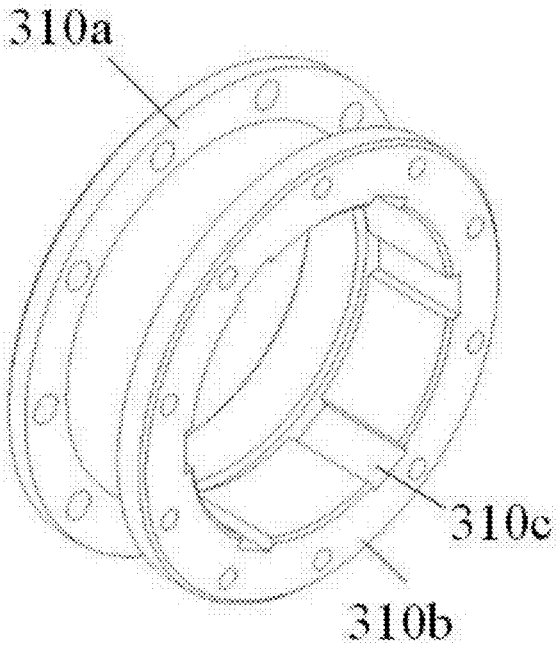
FIG. 8 is a structural schematic diagram of a rotary seat of an angle adjuster in the present invention.
Figure 9:
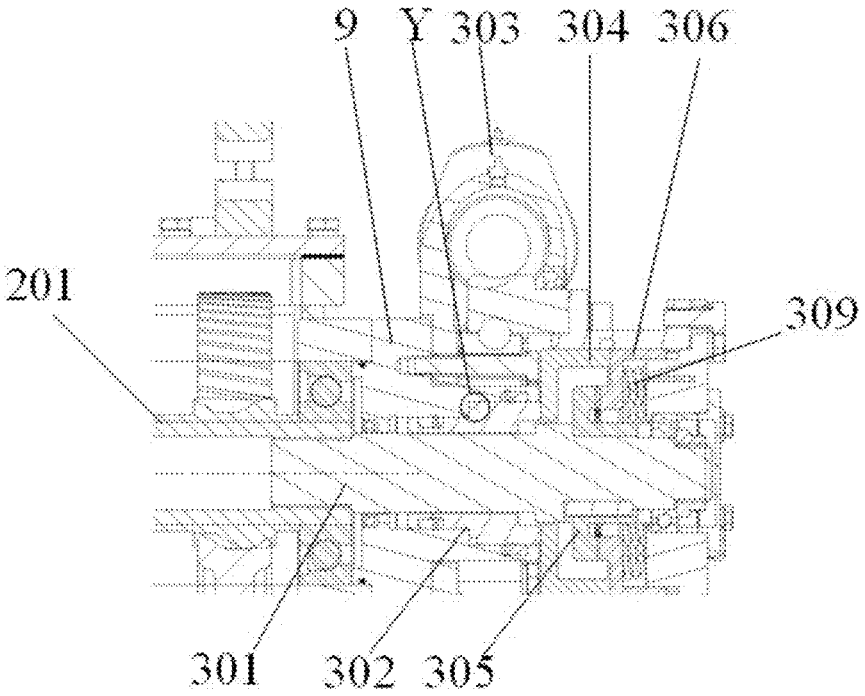
FIG. 9 is a local amplified structural schematic diagram of an angle adjuster in the present invention.
Figure 10:
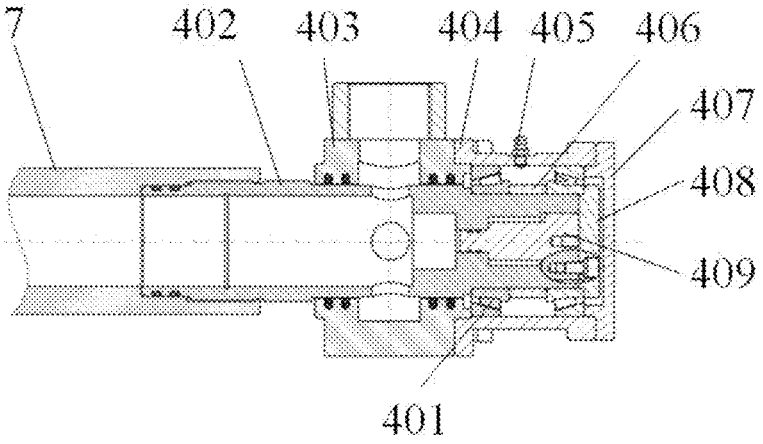
FIG. 10 is a structural schematic diagram of a water swivel in the present invention.
Figure 11:
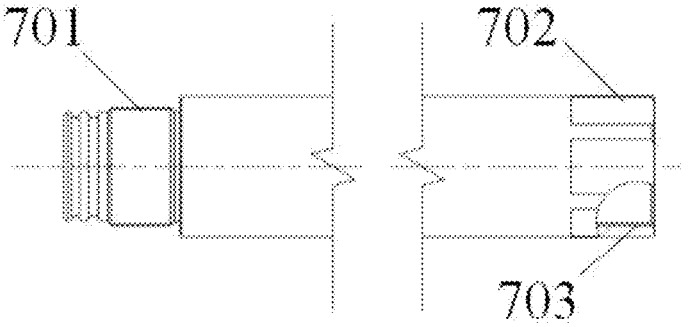
FIG. 11 a structural schematic diagram of a connecting shaft in the present invention.

Referring to FIGS. 1-11, a power head of a directional drill is shown, comprising a main motor 1, a gearbox 2, an angle adjuster 3, a water swivel 4, a chuck 5, a main shaft 10, a connecting shaft 7, a connecting sleeve 8 and an active drill pipe 6, wherein the main motor 1 is connected with the main shaft 10 through the gearbox 2, the active drill pipe 6 is connected with one end of the main shaft 10 through the chuck 5, the water swivel 4 is arranged on one end of the gearbox 2 corresponding to the active drill pipe 6 and is connected with the active drill pipe 6 through the connecting shaft 7 which is arranged in the main shaft 10, the angle adjuster 3 is arranged on one end of the gearbox 2 corresponding to the main motor 1, and a transmission shaft 301 in the angle adjuster 3 is circumferentially and fixedly connected with a driving shaft 201 in the gearbox 2.

The main motor 1 is one of the power sources driving the active drill pipe 6 to rotate, the rotation power required for rotary drilling, combined drilling, and drill pipe connection and disconnection is from the main motor 1, and the main motor 1 can be various rotary power driven devices, for example: one of the power driven devices such as hydraulic motor and electric motor. According to complex working conditions and explosion-proof requirements of a coal mine, the main motor 1 in the present embodiment is preferably a hydraulic motor.

The gearbox 2 is a variable speed transmission mechanism of the power head of a directional drill, which is mainly used for transferring rotation speed and torque output by the main motor 1 and the angle adjuster 3 to the main shaft 10 (i.e., to the drill pipe) in a certain transmission ratio, thus to meet the requirements of drilling as well as drill pipe connection and disconnection. According to existing hydraulic motor technology and drilling needs, the gearbox 2 is generally a gearbox with decelerating, torque increasing and transferring functions. The gearbox 2 is provided with the driving shaft 201, one end of the driving shaft 201 is splined with an output shaft of the main motor 1 to realize circumferential and fixed connection, and the other end is splined with the transmission shaft 301 in the angle adjuster 3 to realize circumferential and fixed connection, thereby transferring the rotation speed and torque output by the main motor 1 and the angle adjuster 3 to the main shaft 10 and the active drill pipe 6 in a certain transmission ratio, thus to meet the requirements of directional drilling as well as drill pipe connection and disconnection.

The angle adjuster 3 comprises a transmission shaft 301, a rotary seat 310, a connecting seat 9, a bearing gland 308 and springs 309; a driving piston 302, a transmission piston 304, a fixed toothed disk 305, a moving toothed disk 306 and an angle adjuster end cover 307 which are sheathed on the transmission shaft 301 from left to right in sequence; and a rotary speed reducer 303 with a self-locking function. A transmission ratio of the rotary speed reducer 303 is greater than that of the gearbox 2; a left end of the transmission shaft 301 is provided with a spline which is inserted into the driving shaft 201 of the gearbox 2, and the driving shaft 201 is provided with a keyway matched with the spline on the transmission shaft 301, thus to make the transmission shaft 301 form a spline connection with the driving shaft 201 and then form a circumferential and fixed connection; and a right end of the transmission shaft 301 is connected with the fixed toothed disk 305 sheathed on the transmission shaft 301 through a flat key 311 to form a circumferential and fixed connection, and is rotationally connected in the angle adjuster end cover 307 through a bearing, the angle adjuster end cover 307 is located on one side of the fixed toothed disk 305 away from the driving shaft 201, i.e., located on a right side of the fixed toothed disk 305, distance sleeves 406 are arranged on both sides of the bearing, the bearing gland 308 which is fixedly connected with the angle adjuster end cover 307 by bolts is arranged on one side of the angle adjuster end cover 307 away from the fixed toothed disk 305, thus to position the bearing.

The driving piston 302 is a hollow two-stage stepped shaft and is sheathed on the transmission shaft 301, a sealing groove 302*a* is formed in an outer circle of a small-diameter end, a sealing ring is installed in the sealing groove 302*a* and is matched with an inner hole in a corresponding position of the connecting seat 9 sheathed on the driving piston 302 to form a first seal, and an outer circle 302*b* of a large-diameter end is matched with a sealing ring installed in a sealing ring mounting groove in a corresponding position of the connecting seat 9 to form a second seal; and a sealing cavity Y located between the driving piston 302 and the connecting seat 9 is formed in the first seal and the second seal, an oil inlet communicated with the sealing cavity Y is arranged on the connecting seat 9, hydraulic oil enters the sealing cavity Y through the oil inlet on the connecting seat 9 to push the driving piston 302 to move from the small-diameter end to the large-diameter end, and the small-diameter end of the driving piston 302 is an end close to the driving shaft 201.

Preferably, a two-stage stepped inner hole is formed in the driving piston 302, one side facing the angle adjuster end cover 307 is a large-diameter inner hole, and the transmission shaft 301 is correspondingly provided with a shaft shoulder matched with the two-stage stepped inner hole to limit a displacement distance of the driving piston 302 in an axial direction, thus to prevent the driving piston 302 from moving beyond limit.

The transmission piston 304 is a disk-like part with a central through hole and is sheathed on the transmission shaft 301, a left end of the transmission piston 304 is in contact and connected with the large-diameter end of the driving piston 302, a right end of the transmission piston 304 is in contact and connected with the moving toothed disk 306, and a main function of the transmission piston 304 is to transfer a driving force of the driving piston 302 (the driving force of displacement to the right end) to the moving toothed disk 306, thus to make the moving toothed disk 306 move towards the angle adjuster end cover 307.

A main body of the moving toothed disk 306 is a disk-like part with a central through hole, a stepped through hole is formed in the middle for the transmission shaft 301 and a fixed shaft 305*b* of the fixed toothed disk 305 to pass through, one side of the through hole facing the angle adjuster end cover is a large-diameter through hole, an inner end surface of the large-diameter through hole is used for withstanding an end thrust force of the springs 309, one end surface of the moving toothed disk 306 facing one side of the transmission piston 304 is provided with first skewed teeth 306*b* distributed circumferentially, an outer circular surface of the moving toothed disk 306 is provided with lug bosses 306*a* distributed uniformly, and the lug bosses 306*a* are matched with grooves 310*c* in an inner hole of the rotary seat 310 sheathed thereon, thus to transfer rotation and torque of the rotary speed reducer 303 connected with the rotary seat 310.

The fixed toothed disk 305 is provided with a toothed disk 305*a* and the fixed shaft 305*b* located in a center of the toothed disk 305*a*, the fixed shaft 305*b* is a hollow shaft, an inner through hole thereof is provided with a keyway which can form a key connection between the fixed toothed disk 305 and the transmission shaft 301, thus to realize a circumferential and fixed connection to limit rotation between the fixed toothed disk 305 and the transmission shaft 301, the fixed shaft 305*b* is inserted into the central through hole of the moving toothed disk, and one end surface of the toothed disk 305*a* facing the moving toothed disk 306 is provided second skewed teeth which are engaged correspondingly with the first skewed teeth 306*b* of the moving toothed disk 306 and distributed circumferentially. Specifically, the fixed toothed disk 305 is fixed on the transmission shaft 301 through the flat key 311 to prevent relative rotation of the fixed toothed disk 305 and the transmission shaft 301. Both ends of the fixed toothed disk 305 are axially stopped by the shaft shoulder of the transmission shaft 301, the distance sleeves 406, etc.

A main body of the angle adjuster end cover 307 has a three-stage stepped hollow disk-like structure, which is sheathed on the transmission shaft 301 through a bearing, a maximum outer diameter section 307*a* is provided with a flange which is connected with the rotary seat 310 sheathed on the moving toothed disk 306 and a flange which is connected with the bearing gland 308, respectively, an intermediate diameter section 307*b* is used for matching with the rotary seat 310 and limiting an axial movement distance of the moving toothed disk 306, a minimum diameter section 307*c* is used for matching with the moving toothed disk 306, i.e., the large-diameter through hole in the moving toothed disk 306 is matched with an outer circle of the minimum diameter section 307*c* to form an axial sliding connection, one end surface of the minimum diameter section is provided with a plurality of mounting holes 307*d* which are used for mounting the springs 309 and distributed circumferentially and uniformly, the minimum diameter section 307*c* is one end of the angle adjuster end cover 307 close to the driving shaft 201, and the bearing gland 308 is fixed on an outer side of the angle adjuster end cover 307 by bolts and used for axially limiting the bearing. The springs 309 are installed between the angle adjuster end cover 307 and the moving toothed disk 306 through the mounting holes 307*d* to provide a thrust force for the moving toothed disk 306 towards the fixed toothed disk 305.

A main body of the rotary seat 310 is cylindrical, which is sheathed on an outer side of the moving toothed disk 306, a left end of the rotary seat 310 is provided with a rotary speed reducer connecting disk 310*a* which is used for connecting an output disk of the rotary speed reducer 303 with a self-locking function, a right end of the rotary seat 310 is provided with an end cover connecting disk 310*b* which is used for installing the angle adjuster end cover 307, and the intermediate diameter section 307*b* in the angle adjuster end cover 307 is matched and connected with an inner cavity of the rotary seat 310 to leave a space for mounting the moving toothed disk 306; and the rotary seat 310 has a through hole in an inner part and grooves 310*c* corresponding to the lug bosses 306*a* of the moving toothed disk 306, a circumferential and fixed connection is formed between the rotary seat 310 and the moving toothed disk 306 by the lug bosses 306*a* and the grooves 310*c*, and the moving toothed disk 306 can be axially displaced relative to the rotary seat 310.

The connecting seat 9 is used for connecting the angle adjuster 3 with the gearbox 2, the gearbox 2 is sheathed on the driving shaft 201 and is mainly used for transferring torque and rotation of the driving shaft 201 to the main shaft 10, the connecting seat 9 is a hollow cylinder, an outer circle of the connecting seat 9 is divided by three diameters, wherein a middle section has a largest diameter to form a middle bulge, both end surfaces of the middle section are fitted and fixedly connected with the gearbox 2 and the rotary speed reducer 303, respectively, to realize relative axial positioning among the three elements, a left section (an end close to the driving shaft 201) is inserted into a cavity of the gearbox 2 and is connected with a bearing sheathed on the driving shaft 201 to be used as an axial stop of the bearing sheathed on the driving shaft 201, and a sealing groove is formed in the left section to seal the cavity of the gearbox 2 by installing a sealing ring; and a right section is extended towards an inner part of the rotary speed reducer 303 to facilitate installation and guidance of the rotary speed reducer 303.

An inner diameter of the connecting seat 9 is divided by three apertures, wherein an inner diameter of a left inner section is matched with the transmission shaft 301 and has a sealing groove to conduct secondary sealing to the gearbox 2 by installing a sealing ring; and a middle inner section and a right inner section are matched with outer diameters of the two-stage stepped shaft of the driving piston 302, respectively, the right inner section has a sealing ring mounting groove and is provided with a sealing ring, i.e., the middle inner section and the right inner section are matched with the outer circle of the small-diameter end and the outer circle 302*b* of the large-diameter end of the driving piston 302, respectively, to form the first seal and the second seal, thus to form the sealing cavity Y, wherein a sealing groove 302*a* corresponding to the middle inner section and provided with the sealing ring is formed in the driving piston 302 to form the first seal, the right inner section having the sealing ring mounting groove and provided with the sealing ring is matched with the outer circle 302*b* of the large-diameter end to from the second seal, the sealing cavity Y located between the connecting seat 9 and the driving piston 302 is formed by the first seal and the second seal, the oil inlet is arranged on an outer surface of the connecting seat 9 in a position corresponding to the sealing cavity Y, and hydraulic oil enters the sealing cavity Y through the oil inlet on the connecting seat 9 to push the driving piston 302 to move towards the right end, thus to push the transmission piston 304 and the moving toothed disk 306, and further compress the springs 309 by the moving toothed disk 306, thereby disengaging the skewed teeth of the moving toothed disk 306 and the fixed toothed disk 305.

The rotary speed reducer 303 is sheathed on the right section of the connecting seat 9 and is fixedly connected with the middle section of the connecting seat 9, and the output disk (such as the toothed disk or a worm gear) of the rotary speed reducer 303 is fixedly connected with the rotary seat 310 by bolts, thus to limit relative rotation of the output disk of the rotary speed reducer 303 and the rotary seat 310. The rotary speed reducer 303 mainly has two functions: the first is to drive the driving shaft 201 by the transmission shaft 301 to rotate at a relatively low speed (compared with being driven by the main motor 1), and transfer the rotation by the gearbox 2 to accurately control an output rotation angle; the second is to prevent the main motor 1 from driving the driving shaft 201 to rotate, thus to realize locking and anti-rotation of the whole gearbox 2 in a locked condition because the rotary speed reducer 303 has a self-locking action and a self-locking torque of the rotary speed reducer 303 is greater than the output torque of the main motor 1.

Preferably, the rotary speed reducer 303 is a worm and gear rotary speed reducer with a self-locking function, i.e., the rotary speed reducer connecting disk 310*a* is connected with a worm gear which is used as the output disk in the worm and gear rotary speed reducer, and the worm gear is sheathed on the transmission shaft 301 through the connecting seat 9 and the driving piston 302, thus to ensure synchronous rotation of the worm gear and the rotary seat 310. A transmission ratio of an existing worm and gear rotary speed reducer can reach greater than 1:100, but the main shaft driven by the main motor 1 in the prior art (the main shaft is driven by the gearbox 2) has a minimum rotation speed of about 50 r/min (300°/s), and therefore, an output rotation speed of the main shaft can be controlled to be within 1/100 (≤3°/s) of the prior art by the angle adjuster 3 through the worm and gear rotary speed reducer, which will be very conducive to accurate adjustment and timely stop, and greatly improve toolface azimuth adjustment accuracy and adjustment efficiency.

Specifically, the worm and gear rotary speed reducer comprises a driving source, a worm, a worm gear and a rotary support, the rotary support is sheathed on and fixedly connected with the connecting seat, the worm gear is rotationally connected with an outer circle of the rotary support through a raceway and is matched and connected with the worm, thus to achieve a purpose of making the output disk (i.e., the worm gear) of the rotary speed reducer coaxial with the rotary seat, and the driving source is connected with one end of the worm to drive the worm to rotate. As worm and gear transmission has a characteristic of reverse self-locking and can realize reverse self-locking, i.e., the worm gear can be driven by the worm, but the worm cannot be driven by the worm gear, the worm and gear rotary speed reducer has the self-locking function. The driving source is an electric motor or a hydraulic motor, and is preferred to be a hydraulic motor in the present embodiment in order to be suitable for complex coal mine downhole operations.

In other embodiments, the rotary speed reducer 303 is any one of the rotary speed reducers such as an RV speed reducer and a harmonic speed reducer, and a structure used as the output disk (or called a rotary disk) in the above-mentioned rotary speed reducer 303 is also fixedly connected with the rotary seat 310.

The angle adjuster 3 has two working conditions, and a working principle thereof is as follows:

Locked condition: no pressure oil enters the sealing cavity Y formed between the driving piston 302 and the connecting seat 9 from the oil inlet of the connecting seat 9, the driving piston 302 is not driven by externally supplied pressure oil, and an axial force towards the fixed toothed disk 305 is always exerted by the springs 309 onto the moving toothed disk 306 to keep the skewed teeth of the moving toothed disk 306 engaged with the skewed teeth of the fixed toothed disk 305; at this time, the main motor 1 and the driving shaft 201 are connected with the rotary speed reducer 303 through the transmission shaft 301, the fixed toothed disk 305, the moving toothed disk 306 and the rotary seat 310, and the rotary speed reducer 303 has a self-locking function within a working capacity thereof (i.e., the self-locking torque of the rotary speed reducer 303 is greater than the output torque of the main motor 1), thus to lock a transmission system of the gearbox 2, and the main motor 1 cannot transfer motion through the gearbox 2; however, if the rotary speed reducer 303 is driven at this time, the driving shaft 201 can be driven by the rotary speed reducer 303 to rotate at a relatively low speed (compared with being driven by the main motor), and the rotation and torque are transferred by the gearbox 2 to accurately control a rotation angle of the main shaft 10 and the active drill pipe 6, thus to conduct accurate and efficient adjustment to the toolface azimuth.

Unlocked condition: pressure oil is injected into the sealing cavity Y between the driving piston 302 and the connecting seat 9 through the oil inlet of the connecting seat 9, the driving piston 302 is driven by a hydraulic force to push the transmission piston 304 and the moving toothed disk 306 to move in a direction away from the fixed toothed disk 305, at this time, the springs 309 are compressed by the moving toothed disk 306 and retract, the skewed teeth of the moving toothed disk 306 and the fixed toothed disk 305 are disengaged, and the self-locking action of the rotary speed reducer 303 cannot be transferred to the transmission shaft 301, the driving shaft 201 and the main motor 1. Therefore, the driving shaft 201 can be driven by the main motor 1 to rotate, thus to output rotation and torque by the gearbox 2.

The water swivel 4 is a water inlet device for drilling driving water, the driving water enters the main shaft 10 of the power head through the water swivel 4 and then reaches a position of a drill bit through a plurality of connected drill pipes, a main feature of the water swivel 4 is axial force balance, the water swivel 4 comprises a mandrel 402, a water inlet assembly 403, a bearing seat 404, a sealing shaft 409 and mandrel support bearings 401, the water inlet assembly 403 is sheathed on and rotationally connected with the mandrel 402, the bearing seat 404 is sheathed on and rotationally connected with the mandrel 402 through the mandrel support bearings 401 which are arranged in both ends of the bearing seat 404, and the sealing shaft 409 is connected with a right end of the mandrel 402 by threads to seal the right end of the mandrel 402.

The mandrel 402 is a hollow shaft, a left end of the mandrel 402 is fixedly connected with the connecting shaft 7 by threads, the threads on the mandrel 402 are external threads, the threads on the connecting shaft 7 are internal threads, a middle part of the mandrel 402 has a water inlet hole, the water inlet hole is communicated with the water inlet assembly 403, and the right end of the mandrel 402 is internally provided with mounting threads used for mounting the sealing shaft 409.

The water inlet assembly 403 comprises a water inlet and a shell communicated with the water inlet. The water inlet is used for connecting a water pipe joint, the shell is sheathed on and rotationally connected with the mandrel, an inner cavity of the shell is communicated with the water inlet hole of the mandrel 402, the shell is matched with the bearing seat 404, i.e., one side of the shell is connected with one side of the bearing seat 404 to form a mandrel mounting structure, at the same time, the inner cavity of the shell has a symmetrical structure with a plane of symmetry perpendicular to an axis of the mandrel 402 so as to make the shell uniformly stressed in an axial direction, and therefore, the axial force balance of the water swivel 4 can be achieved. As the inner cavity of the shell in the water inlet assembly 403 is completely symmetrical about a median surface, an acting force of the driving water on the water inlet assembly 403 is balanced in the axial direction of the mandrel, so as to improve a stress condition of the mandrel support bearings 401 and extend service life.

Preferably, a sealing ring is arranged between the shell and the mandrel 402 to form a sealing structure.

Specifically, a cover plate 408 is installed on the right end of the mandrel 402 by screws to axially fix the sealing shaft 409, and a water swivel end cover 407 is installed on a right end of the bearing seat 404 by screws to axially fix the mandrel support bearings 401. The bearing seat 404 is provided with a grease nipple 405 which is communicated with an inner cavity of the bearing seat 404. A sealing ring is arranged at a junction between the sealing shaft 409 and the mandrel 402 to seal the junction and prevent water leakage.

The connecting shaft 7 is a hollow shaft and is arranged in the main shaft 10, both ends of the connecting shaft 7 are connected with the mandrel 402 of the water swivel 4 and the active drill pipe 6, respectively, to transfer an axial impact on the water swivel 4 to the active drill pipe 6 having an axial floating structure, thus to improve a stress condition of the water swivel 4. A left end of the connecting shaft 7 is provided with external threads 701 which are used for being connected with a threaded hole in a right end of the active drill pipe 6, and a right end of the connecting shaft 7 is provided with internal threads 703 which are used for being connected with the external threads of the mandrel 402 of the water swivel. A hexagonal head 702 is arranged on an outer side of the right end of the connecting shaft 7, the connecting sleeve 8 is fixedly connected with one end of the main shaft 10 of the power head close to the water swivel 4 by threads, an inner hole of the connecting sleeve 8 is a hexagonal hole matched with the hexagonal head 702, the hexagonal head 702 on the right end of the connecting shaft 7 is inserted into the hexagonal hole of the connecting sleeve 8 to form a moving pair between the connecting sleeve 8 and the connecting shaft 7 and limit rotation of the connecting shaft 7, and the moving pair formed between the connecting sleeve 8 and the connecting shaft 7 is matched with the axial floating structure for displacement limitation of the active drill pipe 6 so that an entirety of the mandrel 402, the connecting shaft 7 and the active drill pipe 6 is also provided with the axial floating structure for displacement limitation, thus to make the mandrel 402 in the water swivel 4 and the connecting shaft 7 also have an axial floating function.

The axial floating structure of the active drill pipe 6 comprises springs and a drill pipe end cover, the active drill pipe 6 can be connected with the chuck 5 in a way of torque transfer through the spline, the flat key, etc., spring mounting holes are formed in a right end surface of the active drill pipe 6, and the springs are installed between the active drill pipe 6 and the chuck 5 through the spring mounting holes, thus to make the active drill pipe 6 have the axial floating function to cushion an axial impact, and axial limitation is achieved by the drill pipe end cover fixedly connected with the chuck 5, thus to make the active drill pipe 6 have the axial floating function for displacement limitation.

Specifically, assuming that a maximum distance between the right end surface of the active drill pipe 6 and a left end surface of the chuck 5 corresponding to the active drill pipe 6 is a, and a pitch of the threads of the active drill pipe 6 and a drill pipe joint connected with the active drill pipe 6 is p, then $a \leq p$. This is because that an axial impact of threaded connection will certainly occur within a displacement of a pitch (of course, it is very likely that the impact occurs at each pitch); if one thread (one pitch) cannot be connected, it is certain that subsequent threads cannot be connected. However, a floating distance should not be too small; if the floating distance is too small, a floating cushioning effect cannot be played due to insufficiency of the floating distance. Therefore, according to the characteristics of being basically symmetrical on both sides of the threads, a minimum value of a is slightly greater than 0.5p, preferably $a \in [0.65p, 0.95p]$, and most preferably 0.65p.

A uniformly distributed multi-section axial stop end surface is naturally formed by the hexagonal head 702 of the connecting shaft 7 and the intermediate cylindrical section, and the stop end surface is matched with a left end surface of the connecting sleeve 8 and can limit rightward axial displacement of the connecting shaft 7. Assuming that when the active drill pipe 6 and the connecting shaft 7 are located at a foremost end under a floating action, and the distance between the stop end surface and the left end surface of the connecting sleeve 8 is b, it should be that b>a. This is because that such a distance setting can play the floating function of the active drill pipe, and prevent an axial rightward impact from being transferred directly from the connecting shaft 7 to the mandrel support bearings. In addition, as the distance b is appropriately greater (i.e., not much greater) than the distance a between the end surfaces of the active drill pipe and the chuck, preferably b≥a+0.35p, a cushioning distance of more than one pitch can be ensured even when a minimum preferred value of 0.65p is selected for a, so that an axial cushioning structure has better cushioning and protection effects, and can limit the rightward displacement of the connecting shaft 7 and prevent serious damage to the chuck 5 or other parts of the power head in an extreme case that the floating function of the active drill pipe fails or the end surfaces of the active drill pipe and the chuck are crushed.

The main shaft 10 is arranged in a box body of the gearbox 2 and driven by the gearbox 2 to rotate, one end of the main shaft 10 away from the water swivel 4 is connected with the chuck 5 to drive the chuck 5 to rotate, and then the torque is transferred to the active drill pipe 6 by the chuck 5. That is, the mandrel 402, the sealing shaft 409 and the cover plate 408 in the water swivel 4, the active drill pipe 6, the connecting shaft 7 and the connecting sleeve 8 are rotated relative to the water inlet assembly 403, the bearing seat 404, the water swivel end cover 407 and the box body of the gearbox 2.

Through the above connection relationship, the axial force balance of the water swivel 4 can be achieved during drilling, thus to solve the problem that the mandrel support bearings 401 are easy to damage. A working principle thereof is as follows:

The drilling driving water enters the mandrel 402 from the water inlet assembly 403, passes through the mandrel 402, the connecting shaft 7 and the active drill pipe 6, and then directly reaches a downhole motor and the drill bit. Firstly, as the inner cavity of the shell of the water inlet assembly 403 is completely symmetrical about a median surface, an acting force of the driving water on the water inlet assembly 403 is balanced in the axial direction of the mandrel 402, so that the stress condition of the mandrel support bearings 401 is greatly improved, and the service life is extended;

Secondly, the mandrel 402 of the water swivel 4 is connected with the active drill pipe 6 through the connecting shaft 7, the hexagonal head of the connecting shaft 7 is matched with the hexagonal hole of the connecting sleeve 8 to form a stable moving pair and prevent relative rotation, the active drill pipe 6 has the axial floating function for displacement limitation, which can float back and forth to cushion an axial impact on the power head during drilling and limit axial floating distances of the active drill pipe 6, the connecting shaft 7 and the mandrel 402, thus to protect other related parts and make the connecting shaft 7 and the mandrel 402 have axial floating displacements, therefore, the water swivel 4 (the mandrel 402) is moved axially with the active drill pipe 6 and the connecting shaft 7 during rotation with the active drill pipe 6 and drilling with the power head, an axial impact on the water swivel 4 (the mandrel 402) is transferred to the active drill pipe 6, and the active drill pipe 6 is cushioned by the springs installed between the active drill pipe 6 and the main shaft 10 to further improve the stress condition of the mandrel support bearings 401.

Axial displacement limitation of the drill pipe end cover on the active drill pipe 6 can be adjusted adaptively according to actual needs of other related parts and components in order to adapt to different coal mine drills.

To sum up, the solution that the impact is transferred to the active drill pipe 6 with the floating function by the connecting shaft 7 in combination with the symmetrical inner cavity of the shell in the water inlet assembly of the water swivel 4 improves the stress condition of the mandrel support bearings 401, the axial force generated by the pressure of the drilling driving water in the water swivel 4 is evenly distributed, and the working impact of the power head is withstood by the active drill pipe 6 with the floating function; therefore, the drilling driving water pressure balancing mechanism solves the problems that the hydraulic force in the water swivel of an existing drill is not balanced, no force conductive mechanism is provided and the mandrel support bearings 401 are easy to damage, and is especially suitable for a condition when the pressure of the drilling driving water is high, such as when a mud pulse is used in directional drilling.

The chuck 5 is a drill pipe clamping mechanism of the power head of the directional drill. In general, the chuck 5 in the present embodiment does not undertake the work of clamping the drill pipes for drilling, so a normally open chuck 5 is preferred, thus to remove the active drill pipe 6 at a front end of the chuck 5 and use the chuck 5 to clamp the corresponding drill pipe for construction when it is necessary to temporarily replace a drill pipe with a larger diameter or a fishing drill pipe during downhole drilling. Specifically, a piston type hydraulic chuck disclosed by a Chinese patent with the publication number of CN105822238B is preferred.

The active drill pipe 6 is a drill pipe connecting mechanism during normal drilling, a front end of the active drill pipe 6 is provided with a threaded joint similar to a male joint of the drill pipe, which is used for connecting the drill pipe inserted into the drill during drilling, the active drill pipe 6 is connected with the front end of the chuck 5 by the drill pipe end cover and bolts to limit the axial displacement of the active drill pipe, and the springs are arranged between the active drill pipe 6 and the chuck 5 to make the active drill pipe 6 have the axial floating function.

In another embodiment, the active drill pipe 6 is directly connected with the main shaft 10, a specific structure thereof is the same as a floating drill pipe connecting device disclosed by a Chinese patent with the publication number of CN112253017B, which also has the axial floating function to meet the requirement that one end of the connecting shaft 7 is connected with the active drill pipe having an axial floating structure, the key is to transfer the active drill pipe 6 from being connected with the chuck 5 to being connected with the main shaft 10, and other details are disclosed in the above-mentioned patent and are not repeated herein.

The power head of a directional drill with rotation angle control and braking functions can provide various working conditions including sliding directional drilling, toolface azimuth adjustment, rotary drilling, combined drilling and drill pipe fishing for the directional drill. A working principle thereof is as follows:

(1) Sliding Directional Drilling

In the working condition of sliding directional drilling, the angle adjuster 3 is in the locked condition, and the main shaft 10 cannot be driven by the main motor 1 to rotate; and the power head is connected with a plurality of drill pipes through the active drill pipe 6, and the downhole motor is installed on a front end of the drill pipe at the foremost end. A drilling driving medium (pressure fluid) enters the power head from the water swivel 4, and enters the downhole motor through the connecting shaft, the active drill pipe and the drill pipes in sequence to drive the downhole motor to rotate and implement sliding directional drilling.

(2) Toolface Azimuth Adjustment

In the working condition of toolface azimuth adjustment, the angle adjuster 3 is in the locked condition, and the main shaft 10 cannot be driven by the main motor 1 to rotate, but can only be driven by the rotary speed reducer 303 to rotate; at this time, the oil is not supplied to the main motor 1, but supplied to the hydraulic motor in the rotary speed reducer 303.

The transmission shaft 301 is driven by the rotary speed reducer 303 to rotate, the main shaft 10 and the active drill pipe 6 are driven by the driving shaft 201 in the gearbox 2 to rotate, and then the drill pipe connected with the active drill pipe 6 is driven by the active drill pipe 6 to rotate, thus to achieve the toolface azimuth adjustment. Due to the large transmission ratio of the rotary speed reducer 303 and the transmission ratio of the gearbox 2, efficient and accurate toolface azimuth adjustment can be achieved by controlling the rotation speed of the rotary speed reducer 303.

(3) Rotary Drilling

In the working condition of rotary drilling, the angle adjuster 3 is in the unlocked condition, the main shaft 10 can be driven by the main motor 1 to rotate, and the main shaft 10 and the drill pipes can be driven to rotate by supplying oil to the main motor 1 to implement rotary drilling; at this time, the driving medium is not supplied to the downhole motor through the water swivel 4.

(4) Combined Drilling

In the working condition of combined drilling, the angle adjuster 3 is in the unlocked condition, and the main shaft 10 can be driven by the main motor 1 to rotate. At this time, the driving medium is supplied to the downhole motor through the water swivel 4, thus to drive the downhole motor to rotate, and then the drill pipes are driven by the main motor 1 to rotate in order to achieve combined drilling.

(5) Drill Pipe Fishing

In case a drill pipe is lost, it is necessary to use a fishing drill pipe to take out the drill pipe from a hole. Generally, the diameter of the fishing drill pipe is larger than the diameter of an engineering drill pipe, so it is necessary to use the chuck 5 to clamp the fishing drill pipe for construction. In the working condition of drill pipe fishing, it is necessary to first remove the active drill pipe 6, the connecting shaft 7, the water swivel 4, etc., install the fishing drill pipe into the power head, clamp the fishing drill pipe by the chuck 5, and then connect a plurality of fishing drill pipes in sequence until the fishing drill pipes come into contact with the drill pipe lost in the hole. In this working condition, the angle adjuster 3 is in the unlocked condition, and the main shaft 10 can be driven by the main motor 1 to rotate.

Finally, it should be noted that the above embodiments are only used for describing, rather than limiting the technical solution of the present invention. Although the present invention is described in detail with reference to the preferred embodiments, those ordinary skilled in the art shall understand that the technical solution of the present invention can be amended or equivalently replaced without departing from the purpose and the scope of the technical solution. The amendment or equivalent replacement shall be covered within the scope of the claims of the present invention.

The invention claimed is:

1. A power head of a directional drill, comprising a main motor, a gearbox and a main shaft, wherein the gearbox is provided with a driving shaft, one end of the driving shaft is connected with the main motor, and the driving shaft is engaged with the main shaft through a gear in the gearbox; the present invention is characterized in that: the other end of the driving shaft is connected with an angle adjuster through the gearbox;

the angle adjuster comprises a transmission shaft, a fixed toothed disk, a moving toothed disk, a rotary seat and a rotary speed reducer with a self-locking function, one end of the transmission shaft is circumferentially and fixedly connected with the driving shaft, the fixed toothed disk and the moving toothed disk are sheathed on the transmission shaft, the fixed toothed disk is engaged with the moving toothed disk through skewed teeth, the fixed toothed disk is circumferentially and fixedly connected with the transmission shaft, the moving toothed disk is rotationally connected with the transmission shaft, and the moving toothed disk can slide along an axial direction of the transmission shaft;

the rotary seat is sheathed on and circumferentially and fixedly connected with the moving toothed disk, and an output disk of the rotary speed reducer is coaxially and fixedly connected with the rotary seat to transfer rotation of the output disk of the rotary speed reducer to the moving toothed disk.

2. The power head of a directional drill as claimed in claim 1, characterized in that: the angle adjuster also comprises a driving piston and a connecting seat, the driving piston is sheathed on the transmission shaft and is located on one side of the fixed toothed disk away from the moving toothed disk, and one end of the driving piston away from the driving shaft is connected with the moving toothed disk;

the connecting seat is sheathed on the driving piston, an outer circle of the connecting seat is divided by three diameters, a middle section has a largest diameter, both end surfaces of the middle section are connected with the gearbox and the rotary speed reducer, respectively, to realize relative axial positioning among the gearbox, the connecting seat and the rotary speed reducer, and an inner diameter of the connecting seat is divided by three apertures, wherein the apertures of two sections away from the gearbox are matched with an outer diameter of the driving piston, and the two sections are sheathed on the driving piston;

the driving piston is a two-stage stepped shaft, a sealing groove is formed in an outer circle of a small-diameter end of the driving piston, a sealing ring is installed in the sealing groove and is matched with a corresponding position of the connecting seat sheathed on the driving piston to form a first seal, an outer circle of a large-diameter end is matched with a sealing ring installed at a corresponding position of the connecting seat to form a second seal, a sealing cavity located between the driving piston and the connecting seat is formed between the first seal and the second seal, an oil inlet communicated with the sealing cavity is arranged on the connecting seat, and the moving toothed disk is pushed by the driving piston to move in a direction away from the fixed toothed disk under the action of hydraulic oil entering the sealing cavity through the oil inlet to enable the moving toothed disk to slide along the axial direction of the transmission shaft.

3. The power head of a directional drill as claimed in claim 2, characterized in that: the angle adjuster also comprises an angle adjuster end cover, the other end of the transmission shaft is rotationally connected in the angle adjuster end cover, the moving toothed disk is a disk-like part with a central through hole, the central through hole is a stepped through hole, one side of the stepped through hole facing the angle adjuster end cover is a large-diameter through hole, the moving toothed disk is sheathed on and slidably connected with the angle adjuster end cover through the large-diameter through hole, one end surface of the moving toothed disk facing the driving piston is provided with first skewed teeth distributed circumferentially, the fixed toothed disk is provided with second skewed teeth engaged with the first skewed teeth, and springs are arranged between an inner end surface of the large-diameter through hole and one end surface of the angle adjuster end cover opposite to the inner end surface to make the first skewed teeth and the second skewed teeth engaged under a thrust force of the springs;

an outer circular surface of the moving toothed disk is provided with lug bosses distributed uniformly, the rotary seat is sheathed on the moving toothed disk and has grooves matched with the lug bosses to be circumferentially and fixedly connected with the moving toothed disk, and one end of the rotary seat is provided with a rotary speed reducer connecting disk which is fixedly connected with the output disk of the rotary speed reducer to transfer the rotation of the output disk of the rotary speed reducer to the moving toothed disk.

4. The power head of a directional drill as claimed in claim 3, characterized in that: a transmission piston is also arranged between the driving piston and the moving toothed disk, the transmission piston is sheathed on and slidably connected with the transmission shaft, one end of the transmission piston is connected with the driving piston, and the other end is connected with the moving toothed disk to transmit a thrust force of the driving piston.

5. The power head of a directional drill with rotation angle control and braking functions as claimed in claim 3, characterized in that: the rotary seat is cylindrical, and one end of the rotary seat away from the rotary speed reducer connecting disk is provided with an end cover connecting disk which is fixedly connected with the angle adjuster end cover.

6. The power head of a directional drill as claimed in claim 3, characterized in that: the fixed toothed disk is provided with a toothed disk and a fixed shaft located in a center of the toothed disk, the second skewed teeth are arranged on the toothed disk, the fixed shaft is inserted into the central through hole of the moving toothed disk, and a keyway is provided in the fixed shaft to enable the fixed toothed disk to be circumferentially and fixedly connected with the transmission shaft through key connection.

7. The power head of a directional drill as claimed in claim 3, characterized in that: the angle adjuster end cover has a three-stage stepped hollow disk-like structure, which is sheathed on the transmission shaft through a bearing, a maximum outer diameter section of the angle adjuster end cover is provided with a flange which is connected with the rotary seat, the maximum outer diameter section is located on one end away from the driving shaft, an intermediate diameter section is used for carrying the rotary seat and limiting an axial movement distance of the moving toothed disk, a minimum diameter section is axially and slidably connected with the large-diameter through hole of the moving toothed disk, and one end surface of the minimum diameter section is provided with a plurality of spring mounting holes which are used for mounting the springs and distributed circumferentially and uniformly.

8. The power head of a directional drill as claimed in claim 3, characterized in that: the driving shaft is arranged in the gearbox, one end surface of the middle section of the connecting seat is connected with the gearbox, one section of the connecting seat close to the gearbox is inserted into the gearbox and is used as an axial stop of the bearing sheathed on the driving shaft, and one section of the connecting seat close to the rotary speed reducer is extended towards an inner part of the rotary speed reducer to be used for installation and guidance of the rotary speed reducer.

9. A power head of a directional drill, comprising a main motor, a gearbox, a main shaft, an active drill pipe and a water swivel, wherein the main motor is connected with the main shaft through the gearbox, and one end of the main shaft is circumferentially and fixedly connected with the active drill pipe; the present invention is characterized in that: the power head also comprises a connecting shaft and a connecting sleeve, the water swivel comprises a mandrel, a water inlet assembly, a bearing seat, a sealing shaft and mandrel support bearings, the water inlet assembly is sheathed on and rotationally connected with the mandrel, and the bearing seat is sheathed on and rotationally connected with the mandrel through the mandrel support bearings which are arranged in both ends of the bearing seat;

the mandrel is a hollow shaft, a left end of the mandrel is fixedly connected with the connecting shaft, an inner side of a right end of the mandrel is connected with the sealing shaft to seal the right end of the mandrel, the mandrel has a water inlet hole, the water inlet hole is communicated with the water inlet assembly, the water inlet assembly comprises a water inlet and a shell communicated with the water inlet, an inner cavity of the shell has a symmetrical structure with a plane of symmetry perpendicular to an axis of the mandrel so as to make the shell uniformly stressed in an axial direction, the water inlet assembly is sheathed on the mandrel through the shell, and the inner cavity of the shell is communicated with the water inlet hole of the mandrel;

the connecting shaft is a hollow shaft and is arranged in the main shaft, both ends of the connecting shaft are connected with the mandrel and the active drill pipe having an axial floating structure, respectively, a hexagonal head is arranged on one end of the connecting shaft close to the mandrel, the connecting sleeve is fixedly connected with one end of the main shaft close to the water swivel and is sheathed on the connecting shaft, and a hexagonal hole matched with the hexagonal head is formed in the connecting sleeve to form a sliding connection between the connecting shaft and the connecting sleeve to limit rotation, thus to enable the connecting shaft and the mandrel to float axially.

10. The power head of a directional drill as claimed in claim 9, characterized in that: the power head also comprises a chuck, the chuck is connected with one end of the main shaft away from the water swivel and rotates with the main shaft, the axial floating structure of the active drill pipe comprises springs and a drill pipe end cover, the active drill pipe is in key connection with the chuck to make the main shaft circumferentially and fixedly connected with the active drill pipe, the springs are arranged on one end surface of the active drill pipe close to the chuck to enable the active drill pipe to float axially, and the drill pipe end cover is sheathed on the active drill pipe and is fixedly connected with the chuck to limit an axial floating distance of the active drill pipe.

11. The power head of a directional drill as claimed in claim 10, characterized in that: assuming that a maximum distance between the end surface of the active drill pipe close to the chuck and an end surface of the chuck corresponding to the active drill pipe is a, and a pitch of threads of the active drill pipe and a drill pipe joint connected with the active drill pipe is p, then $a \leq p$.

12. The power head of a directional drill as claimed in claim 10, characterized in that: a uniformly distributed multi-section axial stop end surface is formed by the hexagonal head of the connecting shaft and an intermediate cylindrical section, and the stop end surface is matched with one end surface of the connecting sleeve close to the connecting shaft; assuming that when the active drill pipe floats axially to a leftmost end, a distance between the stop end surface and the end surface of the connecting sleeve close to the connecting shaft is b, then $b>a$.

13. The power head of a directional drill as claimed in claim 9, characterized in that: the mandrel is fixedly connected with the connecting shaft by threads, threads of the mandrel are external threads, and threads of the connecting shaft are internal threads.

14. The power head of a directional drill as claimed in claim 9, characterized in that: the right end of the mandrel is fixedly connected with a cover plate to fix the sealing shaft axially.

15. A power head of a directional drill, comprising a main motor, a gearbox, a main shaft, an active drill pipe and a water swivel, wherein the gearbox is provided with a driving shaft, one end of the driving shaft is connected with the main motor, the driving shaft is engaged with the main shaft through a gear in the gearbox, and one end of the main shaft is circumferentially and fixedly connected with the active drill pipe; the present invention is characterized in that: the other end of the driving shaft is connected with an angle adjuster through the gearbox;

the angle adjuster comprises a transmission shaft, a fixed toothed disk, a moving toothed disk, a rotary seat and a rotary speed reducer with a self-locking function, one end of the transmission shaft is circumferentially and fixedly connected with the driving shaft, the fixed toothed disk and the moving toothed disk are sheathed on the transmission shaft, the fixed toothed disk is engaged with the moving toothed disk through skewed teeth, the fixed toothed disk is circumferentially and fixedly connected with the transmission shaft, the moving toothed disk is rotationally connected with the transmission shaft, and the moving toothed disk can slide along an axial direction of the transmission shaft;

the rotary seat is sheathed on and circumferentially and fixedly connected with the moving toothed disk, and an output disk of the rotary speed reducer is coaxially and fixedly connected with the rotary seat to transfer rotation of the output disk of the rotary speed reducer to the moving toothed disk;

the power head of a directional drill also comprises a connecting shaft and a connecting sleeve, the water swivel comprises a mandrel, a water inlet assembly, a bearing seat, a sealing shaft and mandrel support bearings, the water inlet assembly is sheathed on and rotationally connected with the mandrel, and the bearing seat is sheathed on and rotationally connected with the mandrel through the mandrel support bearings which are arranged in both ends of the bearing seat;

the mandrel is a hollow shaft, a left end of the mandrel is fixedly connected with the connecting shaft, an inner side of a right end of the mandrel is connected with the sealing shaft to seal the right end of the mandrel, the mandrel has a water inlet hole, the water inlet hole is communicated with the water inlet assembly, the water inlet assembly comprises a water inlet and a shell communicated with the water inlet, an inner cavity of the shell has a symmetrical structure with a plane of symmetry perpendicular to an axis of the mandrel so as to make the shell uniformly stressed in an axial direction, the water inlet assembly is sheathed on the mandrel through the shell, and the inner cavity of the shell is communicated with the water inlet hole of the mandrel;

the connecting shaft is a hollow shaft and is arranged in the main shaft, both ends of the connecting shaft are connected with the mandrel and the active drill pipe having an axial floating structure, respectively, a hexagonal head is arranged on one end of the connecting shaft close to the mandrel, the connecting sleeve is fixedly connected with one end of the main shaft close to the water swivel and is sheathed on the connecting shaft, and a hexagonal hole matched with the hexagonal head is formed in the connecting sleeve to form a sliding connection between the connecting shaft and the connecting sleeve to limit rotation, thus to enable the connecting shaft and the mandrel to float axially.

16. The power head of a directional drill as claimed in claim 15, characterized in that: the angle adjuster also comprises a driving piston and a connecting seat, the driving piston is sheathed on the transmission shaft and is located on one side of the fixed toothed disk away from the moving toothed disk, and one end of the driving piston away from the driving shaft is connected with the moving toothed disk;

the connecting seat is sheathed on the driving piston, an outer circle of the connecting seat is divided by three diameters, a middle section has a largest diameter, both end surfaces of the middle section are connected with the gearbox and the rotary speed reducer, respectively, to realize relative axial positioning among the gearbox, the connecting seat and the rotary speed reducer, and an inner diameter of the connecting seat is divided by three apertures, wherein the apertures of two sections away from the gearbox are matched with an outer diameter of the driving piston, and the two sections are sheathed on the driving piston;

the driving piston is a two-stage stepped shaft, a sealing groove is formed in an outer circle of a small-diameter end of the driving piston, a sealing ring is installed in the sealing groove and is matched with a corresponding position of the connecting seat sheathed on the driving piston to form a first seal, an outer circle of a large-diameter end is matched with a sealing ring installed at a corresponding position of the connecting seat to form a second seal, a sealing cavity located between the driving piston and the connecting seat is formed between the first seal and the second seal, an oil inlet communicated with the sealing cavity is arranged on the connecting seat, and the moving toothed disk is pushed by the driving piston to move in a direction away from the fixed toothed disk under the action of hydraulic oil entering the sealing cavity through the oil inlet to enable the moving toothed disk to slide along the axial direction of the transmission shaft.

17. The power head of a directional drill as claimed in claim 15, characterized in that: the angle adjuster also comprises an angle adjuster end cover, the other end of the transmission shaft is rotationally connected in the angle adjuster end cover, the moving toothed disk is a disk-like part with a central through hole, the central through hole is a stepped through hole, one side of the stepped through hole facing the angle adjuster end cover is a large-diameter through hole, the moving toothed disk is sheathed on and slidably connected with the angle adjuster end cover through the large-diameter through hole, one end surface of the moving toothed disk facing the driving piston is provided with first skewed teeth distributed circumferentially, the fixed toothed disk is provided with second skewed teeth engaged with the first skewed teeth, and springs are arranged between an inner end surface of the large-diameter through hole and one end surface of the angle adjuster end cover opposite to the inner end surface to make the first skewed teeth and the second skewed teeth engaged under a thrust force of the springs;

an outer circular surface of the moving toothed disk is provided with lug bosses distributed uniformly, the rotary seat is sheathed on the moving toothed disk and has grooves matched with the lug bosses to be circumferentially and fixedly connected with the moving toothed disk, and one end of the rotary seat is provided with a rotary speed reducer connecting disk which is fixedly connected with the output disk of the rotary speed reducer to transfer the rotation of the output disk of the rotary speed reducer to the moving toothed disk.

* * * * *